US011192756B2

(12) United States Patent
Cui et al.

(10) Patent No.: US 11,192,756 B2
(45) Date of Patent: Dec. 7, 2021

(54) SAFETY CONTROL DEVICE FOR HANDRAIL, CONVEYOR SYSTEM AND SAFETY CONTROL METHOD FOR HANDRAIL

(71) Applicant: Otis Elevator Company, Farmington, CT (US)

(72) Inventors: Hai Cui, Zhejiang (CN); Qing Cheng, Zhejiang (CN); Yi Fang, Zhejiang (CN); Xingsong Xu, Zhejiang (CN); Xinxiang Jiang, Zhejiang (CN); JiaYing Chen, Zhejiang (CN); ShengJun Qian, Zhejiang (CN); HuaLiang Xu, Zhejiang (CN); ShaoDong Huang, Zhejiang (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/097,069

(22) Filed: Nov. 13, 2020

(65) Prior Publication Data

US 2021/0300730 A1 Sep. 30, 2021

(30) Foreign Application Priority Data

Mar. 24, 2020 (CN) ..... 202010212251.1

(51) Int. Cl.
*B66B 23/24* (2006.01)
*B66B 29/00* (2006.01)

(52) U.S. Cl.
CPC ..... *B66B 23/24* (2013.01); *B66B 29/005* (2013.01)

(58) Field of Classification Search
CPC ..... B66B 23/24; B66B 29/005; B66B 29/04
(Continued)

(56) References Cited

U.S. PATENT DOCUMENTS 4,564,099 A * 1/1986 Uozumi ..... B66B 29/005 198/323
5,092,446 A * 3/1992 Sullivan, Jr. ..... B66B 29/04 198/323

(Continued)

FOREIGN PATENT DOCUMENTS

GB 2526368 A 11/2015
JP H03192091 A 8/1991
JP H06255973 A 9/1994

OTHER PUBLICATIONS

European Search Report for Application No. 20215119.7; dated May 26, 2021; 8 Pages.

*Primary Examiner* — James R Bidwell
(74) *Attorney, Agent, or Firm* — Cantor Colburn LLP

(57) ABSTRACT

A handrail safety control device, a transportation system and a handrail safety control method. The handrail safety control device is provided for a transportation system having a handrail, the handrail including a body and a handrail belt, the handrail belt being driven under power to move relative to the body and forming an engaged state or a disengaged state with the body. The handrail safety control device includes: a contact portion disposed in a preset section of the handrail, the contact portion being in a first state or a second state respectively when the handrail belt in the preset section is in the engaged state or the disengaged state, wherein in the first state, the contact portion is in contact with the handrail belt, and in the second state, the contact portion is at least partially out of contact with the handrail belt; and a signal generation portion.

16 Claims, 8 Drawing Sheets

(58) Field of Classification Search
USPC ..... 198/322, 323, 338
See application file for complete search history.

(56) References Cited

U.S. PATENT DOCUMENTS 6,015,038 A * 1/2000 Stoxen ..... B66B 23/24
198/322
6,112,166 A * 8/2000 Joosten ..... B66B 27/00
198/323
7,140,486 B2 * 11/2006 Kim ..... F16H 7/08
198/810.03
7,404,477 B1 * 7/2008 Toennisson ..... B66B 29/005
198/323
8,074,789 B2 * 12/2011 May ..... B65G 43/02
198/810.02

* cited by examiner

SAFETY CONTROL DEVICE FOR HANDRAIL, CONVEYOR SYSTEM AND SAFETY CONTROL METHOD FOR HANDRAIL

This application claims priority to Chinese Patent Application No. 202010212251.1, filed Mar. 24, 2020, and all the benefits accruing therefrom under 35 U.S.C. § 119, the contents of which in its entirety are herein incorporated by reference.

FIELD OF THE INVENTION

The disclosure relates to the technical field of electromechanics and, more particularly, to a handrail safety control device, a transportation system and a handrail safety control method.

BACKGROUND OF THE INVENTION

Transportation systems such as escalators and moving walkways have been already widely used and can bring great conveniences to people's work and travel. Although many types of transportation systems have been provided in the related art to meet various needs, they still have some shortcomings in terms of, for example, structural construction, safety and reliability, manufacturing and maintenance costs, and operational performance.

For example, as shown in FIGS. 1(*a*), 1(*b*) and 1(*c*), handrails are usually provided in these existing transportation systems. The handrail typically includes two portions, namely, a fixedly installed body 22 and a handrail belt 21 detachably installed on the body 22; then, the handrail belt 21 can be driven by a power device such as an electric motor to move relative to the body 22. Under normal circumstances, the handrail belt 21 and the body 22 should be maintained or substantially maintained in an engaged state, and three exemplary situations are schematically shown in FIGS. 1(*a*), 1(*b*) and 1(*c*). As shown in these drawings, although a certain degree of deviation, tilt and the like may occur in the assembly between the handrail belt 21 and a snap-fit structure 200 on the body 22, a detachment/failure phenomenon will not arise. However, in some undesirable situations, as shown in FIGS. 2(*a*) and 2(*b*), for example, the handrail belt 21 in some areas may be detached from the body 22 on one side or even both sides. This disengaged state will pose safety risks to the operation of devices of the transportation system, passengers, etc., and may even cause serious damage. Although many devices are known for test protection and anti-fracture protection of the handrails, they still cannot fully meet the safety protection requirements for the handrails of the transportation system.

SUMMARY OF THE INVENTION

In view of the foregoing, the disclosure provides a handrail safety control device, a transportation system, and a handrail safety control method, thereby resolving or at least alleviating one or more of the problems described above as well as problems of other aspects.

Firstly, according to a first aspect of the disclosure, a handrail safety control device is provided, which is used for a transportation system having a handrail, the handrail including a body and a handrail belt, the handrail belt being driven under power to move relative to the body and forming an engaged state or a disengaged state with the body, the handrail safety control device including: a contact portion disposed in a preset section of the handrail, the contact portion being in a first state or a second state respectively when the handrail belt in the preset section is in the engaged state or the disengaged state, wherein in the first state, the contact portion is in contact with the handrail belt, and in the second state, the contact portion is at least partially out of contact with the handrail belt; and a signal generation portion configured to generate a response signal in response to a switching of the contact portion between the first state and the second state.

In the handrail safety control device according to the disclosure, optionally, the response signal includes a first response signal and/or a second response signal, wherein the first response signal is generated by the signal generation portion when the contact portion is switched from the first state to the second state, and the second response signal is generated by the signal generation portion when the contact portion is switched from the second state to the first state.

In the handrail safety control device according to the disclosure, optionally, the contact portion includes: a base configured to be installed in a cavity between the handrail belt and the body; a shaft installed on the base; a pivoting member pivotally installed on the base around the shaft, and having a first end facing an inner side of the handrail belt and a second end facing the signal generation portion; and a counterweight installed between the second end and the shaft, and configured to cause the first end to be in contact with or at least partially out of contact with the inner side respectively when in the first state or the second state, and to cause the signal generation portion to generate the first response signal and/or the second response signal through a corresponding position change of the second end relative to the signal generation portion.

In the handrail safety control device according to the disclosure, optionally, the signal generation portion comprises a photoelectric sensor installed on the base and having a recess, when the contact portion is switched from the first state to the second state, the second end enters the recess from the outside to cause the photoelectric sensor to generate the first response signal, and when the contact portion is switched from the second state to the first state, the second end leaves the recess to cause the photoelectric sensor to generate the second response signal.

In the handrail safety control device according to the disclosure, optionally, the first end is provided with one or more rolling members for rolling-contact with the inner side.

In the handrail safety control device according to the disclosure, optionally, a fastener is provided between the shaft and the pivoting member, and the fastener includes a snap spring.

In the handrail safety control device according to the disclosure, optionally, the contact portion further includes a cover member detachably installed on the top of the base.

In the handrail safety control device according to the disclosure, optionally, the signal generation portion is connected to a controller for controlling the operation of the transportation system, and the controller is configured to perform safety control operations according to the response signals, the safety control operations including at least one of the following: making the transportation system stop providing or re-provide the power respectively, according to the first response signal or the second response signal; sending or stop sending alarm information respectively, according to the first response signal or the second response signal; marking the handrail in the disengaged state on a management end of the transportation system or cancelling the mark respectively, according to the first response signal or the second response signal, notifying the staff or a user terminal of event information related to the handrail, the user terminal including a mobile terminal; and transmitting the event information related to the handrail to a local and/or cloud server connected to the transportation system for storage.

In the handrail safety control device according to the disclosure, optionally, at least two said handrail safety control devices are provided in the preset section, and the controller is configured to: when the handrail is in a standby mode, make the transportation system stop providing the power after the first response signal generated by at least one handrail safety control device is received; and when the handrail is in an operating mode, make the transportation system not stop providing the power after the first response signals generated by a first preset number of handrail safety control devices are received, and make the transportation system stop providing the power after the first response signals generated by a second preset number of handrail safety control devices are received, the second preset number being greater than the first preset number.

In the handrail safety control device according to the disclosure, optionally, the controller is further configured to make the transportation system not stop providing the power and perform at least one other safety control operation of the safety control operations, after the first response signals generated by a preset number of handrail safety control devices are received.

In the handrail safety control device according to the disclosure, optionally, the preset section is an upper-end R section and/or a lower-end R section of the handrail on at least one side of the transportation system, and at least two said handrail safety control devices are provided in each preset section.

In the handrail safety control device according to the disclosure, optionally, the handrail safety control device further includes a signal processing portion connected to the signal generation portion and configured to perform the safety control operations related to the handrail according to the response signals.

In addition, according to a second aspect of the disclosure, a transportation system is also provided, which includes: a handrail comprising a body and a handrail belt, the handrail belt being driven under power to move relative to the body and forming an engaged state or a disengaged state with the body; and one or more handrail safety control devices according to any one of the above described, for generating the response signals to perform safety control operations.

In the transportation system according to the disclosure, optionally, the transportation system includes an escalator and a moving walkway.

In addition, according to a third aspect of the disclosure, a handrail safety control method is also provided, which includes the steps of: placing a transportation system into an operating state, the transportation system being provided with a handrail and one or more handrail safety control devices according to any one of the above described; monitoring whether a response signal has currently been generated by the handrail safety control device; and if the response signal has been generated, performing a safety control operation according to the response signal.

The principles, features, characteristics, advantages and the like of the various technical solutions according to the disclosure will be clearly understood from the following detailed description in combination with the accompanying drawings. For example, the solutions of the disclosure are easy to manufacture, install and maintain, and have low cost, sensitive and reliable working performance. The device of the disclosure can be conveniently and flexibly arranged at any required position of the handrail of the transportation system so that a timely and accurate safety control can be achieved, which is advantageous for enhancing the safety performance of transportation systems such as escalators and moving walkways, protecting the safety of passengers and devices, and improving product competitiveness.

BRIEF DESCRIPTION OF THE DRAWINGS

The technical solutions of the disclosure will be further described in detail below with reference to the accompanying drawings and embodiments. However, it should be understood that these drawings are designed merely for the purpose of explanation and only intended to conceptually illustrate the structural configurations described herein, and are not required to be drawn to scale.

DETAILED DESCRIPTION OF THE EMBODIMENT(S) OF THE INVENTION

First, it is noted that the structural components, arrangements, characteristics, advantages and the like of the handrail safety control device, the transportation system and the handrail safety control method according to the disclosure will be described below by way of example. However, all the descriptions are not intended to limit the disclosure in any way. Herein, the technical term "connect (or connected, etc.)" covers a situation where a specific component is directly connected to another component and/or indirectly connected to another component, and the technical terms "first" and "second" are only used for the purpose of distinguished expressions, without intention to indicate their order and relative importance.

In addition, for any single technical feature described or implied in the embodiments mentioned herein, or any single technical feature depicted or implied in the accompanying drawings, the disclosure still allows for any combination or deletion of these technical features (or equivalents thereof) without any technical obstacles, so these further embodiments according to the disclosure should also be considered to be within the scope of the disclosure. In addition, for the sake of brevity, identical or similar parts and features may be marked in only one place or several places in the same drawing. In addition, general items that are well known to those skilled in the art such as the composition and structure of an escalator, the working principle and performance characteristics of various existing sensors and the like will not be described in detail herein.

According to the design concept of the disclosure, firstly, a handrail safety control device for a transportation system (such as an escalator, a moving walkway, etc.) is provided. By means of the device, a handrail failure such as derailing can be found in time, which is advantageous for enhancing the safety guarantee by taking measures timely and better protecting passengers and devices. Generally speaking, the handrail safety control device may include two portions, namely, a contact portion and a signal generation portion. The disclosure allows for implementing the above two portions in any possible manner so as to fully adapt to different application requirements.

As for the contact portion, it is arranged in one or more sections of the handrail of the transportation system according to requirements. A contact operation or a non-contact operation is formed between the contact portion and a handrail belt and thereby, it can be reflected that whether the handrail belt at or near the position is currently in an engaged state with a body or in a disengaged state from the body.

Figure 1A:
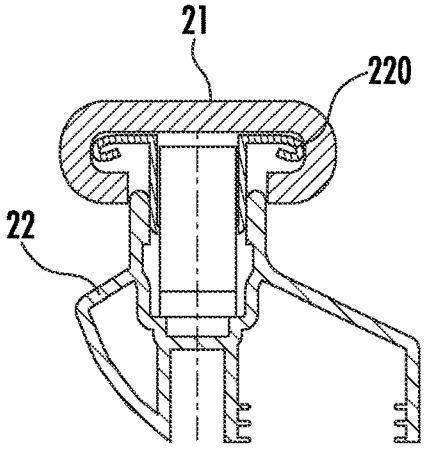
FIGS. 1(*a*)-(*c*) are schematic diagrams showing three situations in which a handrail belt and a body in an existing transportation system are in an engaged state.
Figure 1B:
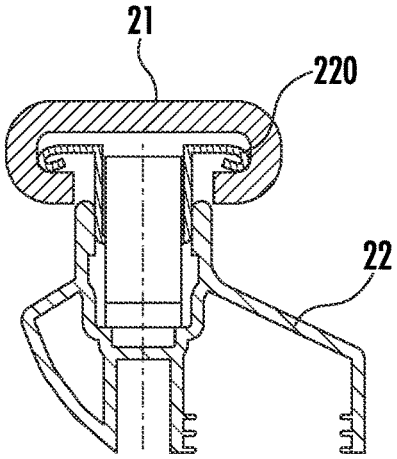
Figure 1C:
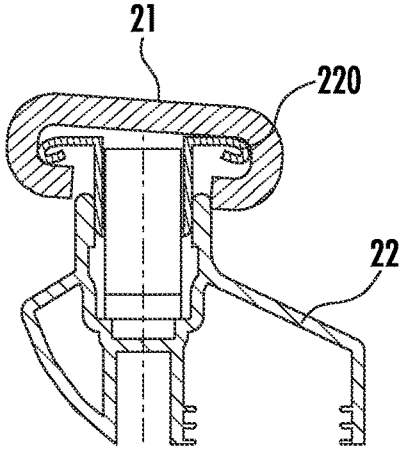
Figure 2A:
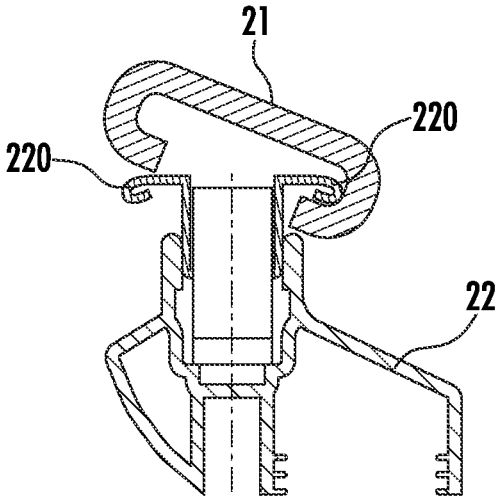
FIGS. 2(*a*)-2(*b*) are schematic diagrams showing two situations in which the handrail belt and the body in the existing transportation system shown in FIGS. 1(*a*)-(*c*) are in a disengaged state.
Figure 2B:
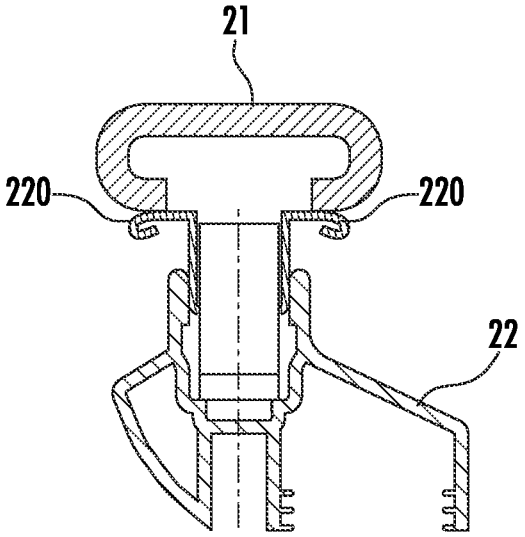

More specifically, the contact portion may be set to have two different states: in a first state, the contact portion may be kept in contact with the handrail belt, which may correspond to a situation where the handrail belt and the body are in a normal engaged state; and in a second state, the contact portion is completely out of contact with the handrail belt, which may correspond to a situation where both sides of the handrail belt 21 are disengaged from the body 22 as shown in FIG. 2 (*b*). Of course, the contact portion may also be partially out of contact with the handrail belt, which may correspond to, for example, a situation where one side of the handrail belt 21 is disengaged from the body 22 as shown in FIG. 2 (*a*), and such single-sided disengagement may cause both sides of the handrail belt 21 to be finally disengaged from the body 22, i.e., a situation where the above-mentioned contact portion is completely out of contact with the handrail belt. Therefore, if the above-mentioned partial out-of-contact situation can be found in time, it will quite advantageous for performing a safety control of the malfunctioning handrail as early as possible to avoid the formation of a greater degree and a wider range of safety risk. In the following, a more detailed exemplary introduction to the contact portion will be given in combination with specific embodiments.

The signal generation portion is another component of the handrail safety control device, it can either be integrated with the contact portion, or be arranged separately from the contact portion. As described above, according to the current state of the contact portion (i.e., the first state or the second state), the current state between the handrail belt and the body in the area where the safety control device is arranged can be reflected (that is, it is a normally-working engaged state or an abnormal disengaged/failure state). That is to say, if it is found that the contact portion has entered the second state from the first state, it can indicate that the handrail belt there has been detached from the body; on the contrary, if it is found that the contact portion has returned to the first state from the second state, it can indicate that the handrail belt and the body have been re-engaged together. As for the signal generation portion, it is designed to respond to the switching of the contact portion between the above two different states in order to generate a corresponding response signal. Such a response signal may be designed as needed, and may be used for the safety control operation on the handrail.

Illustratively, for example, in some applications, it is possible to focus only on the occurrence of a detachment failure of the handrail belt, so only a first response signal may be generated by the signal generation portion, which corresponds to a situation that the contact portion is switched from the first state to the second state. For another example, in some other applications, it may only be necessary to know whether the detached handrail belt has been re-engaged with the body, so only a second response signal may be generated by the signal generation portion, which corresponds to a situation that the contact portion is switched from the second state to the first state. For still another example, in some other applications, the signal generation portion needs to generate not only the first response signal but also the second response signal, so as to more flexibly and fully perform the safety control operation on the handrail.

It should be noted that the signal generation portion in the device of the disclosure may be implemented by using components such as various sensors, controllers, and chips, which will be exemplarily described through an embodiment using a photoelectric sensor. Those skilled in the art can obtain more implementations of the signal generation portion according to the teaching of these exemplary contents.

Referring to FIG. 3 to FIG. 6, the general configuration and working principle of an embodiment of the handrail safety control device according to the disclosure are schematically shown. The device of the disclosure will be described in detail below with reference to this embodiment in combination with these drawings.

In the given embodiment, the handrail safety control device 100 may include a base 11, a shaft 12, a pivoting member 13, a counterweight 14, a rolling member 15, and a photoelectric sensor 31. The signal generation portion discussed above may be constituted by the photoelectric sensor 31, which is installed on the base 11 and is provided with a recess 310 (for example, which may be U-shaped or the like). By detecting a light change generated when the photoelectric sensor 31 enters or leaves the recess 310 and based on the photoelectric effect, the light change signal can be converted into an electrical signal. In this example, the above operating characteristic of the photoelectric sensor is used to generate a response signal, which will be described in more detail later. In the handrail safety control device 100, the remaining components other than the above photoelectric sensor 31 will constitute the contact portion discussed above.

Specifically, the base 11 may provide an accommodation space for the components and play a supporting role. It can be made of a suitable material according to needs, and can be constructed to form any suitable shape. For example, the base 11 may be constructed into a substantially rectangular parallelepiped shape using, for example, aluminum alloy materials, so that the handrail safety control device can have the advantages of light weight, high strength, and resistance to environmental corrosion, and it is easy to install it for example inside a cavity 20 between the handrail belt 21 and the body 22. In specific applications, the disclosure allows a variety of possible connection methods to be used to install the base 11 at any suitable position on the handrail (such as the cavity 20, etc.). For example, one or more connection methods such as welding, fastener connection (such as screws, snaps, etc.), adhesive connection (such as super glue, etc.) may be used.

Figure 3:
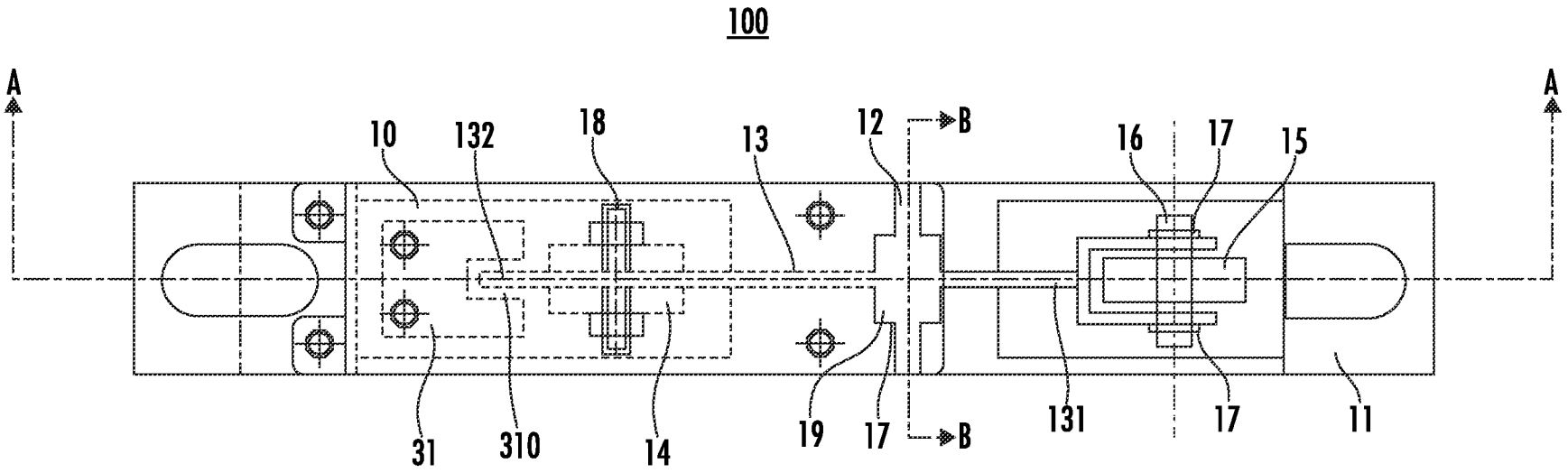
FIG. 3 is a schematic structural side view of an example of a handrail safety control device according to the disclosure.
Figure 4:
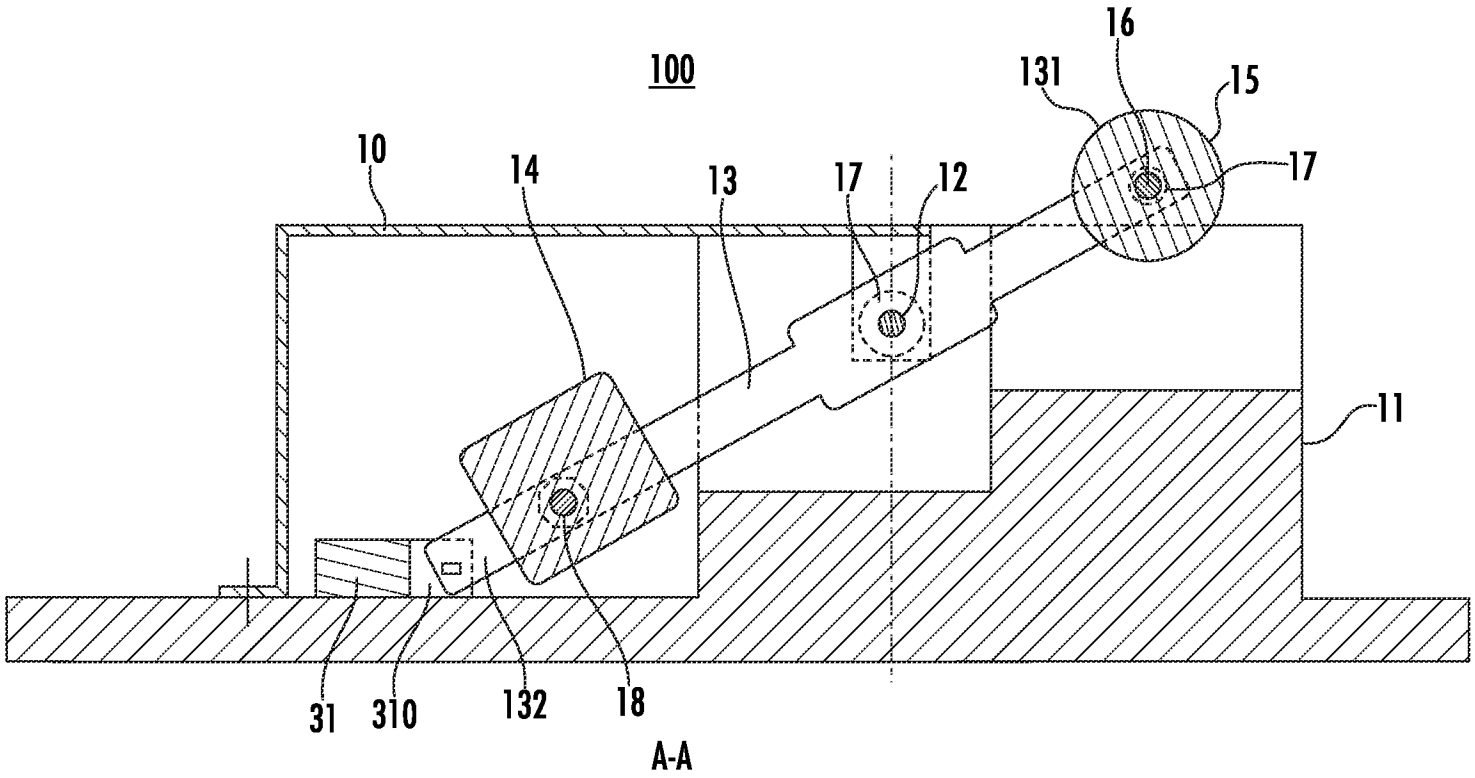
FIG. 4 is a schematic cross-sectional structural view taken along direction A-A in FIG. 3.
Figure 5:
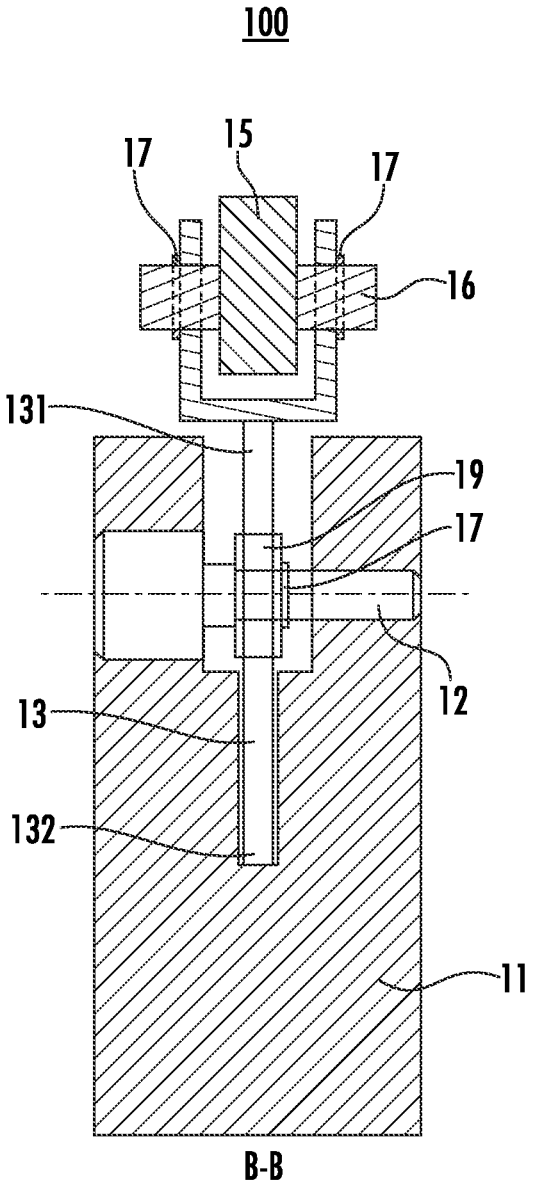
FIG. 5 is a schematic cross-sectional structural view taken along direction B-B in FIG. 3.

As shown in FIGS. 3, 4 and 5, the shaft 12 may be installed on the base 11, and the pivoting member 13 may be arranged to pivot around the shaft 12. The pivoting member 13 is generally configured into a rod shape and has a first end 131 and a second end 132 opposite to each other. As an optional case, a fastener 17 such as a snap spring and a support member 19 such as a linear bearing may be additionally provided to better ensure and enhance the stability of the connection between the shaft 12 and the pivoting member 13.

One or more rolling members 15 may be provided at the first end 131 of the pivoting member 13 for rolling-contact with an inner side 210 of the handrail belt 21. This way of contact, at the same time of maintaining mutual contact, is helpful for reducing the friction loss, promotes the device to work stably for a long period, and avoids the possible influence on the normal operation of the handrail due to the installation of the device of the disclosure. In this embodiment, the rolling members 15 can be installed on the first end 131 through the shaft 16, and fasteners 17 such as snap-springs can be used to secure them in the set assembly positions.

The second end 132 of the pivoting member 13 faces the photoelectric sensor 31, the counterweight 14 is arranged between the second end 132 and the shaft 12, and the counterweight 14 can be fixedly installed on the pivoting member 13 through a connecting member 18 such as a bolt. The shape, size, material used, arrangement position, weight and the like of the counterweight 14 itself can be flexibly set and adjusted according to different application situations, so as to fully meet various needs and achieve the object of the disclosure.

Figure 6:
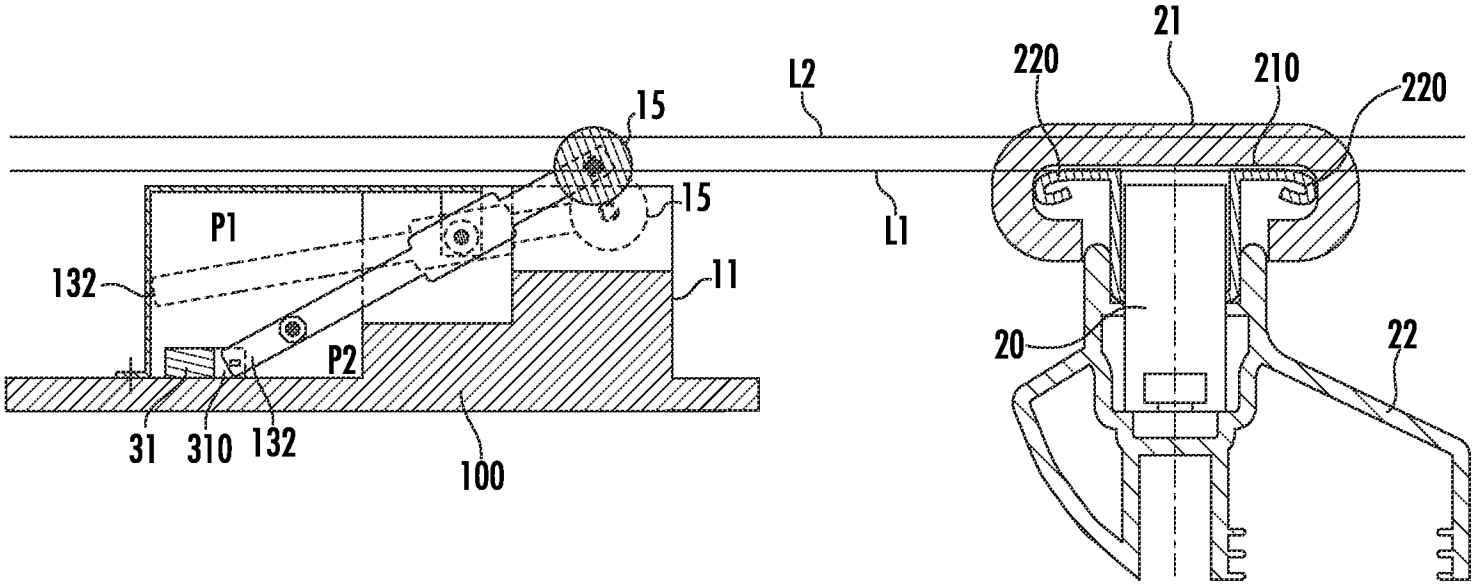
FIG. 6 is a schematic diagram of the working principle of the example of the handrail safety control device shown in FIG. 3.

As shown in FIG. 6, in the initial situation, under the action of gravity force of the counterweight 14, the pivoting member 13 can be caused to pivot around the shaft 12 counterclockwise until the rolling member 15 located at the first end 131 of the pivoting member 13 is in contact with the inner side 210 of the handrail belt 21, which has been shown schematically in FIG. 6 using a horizontal line L1. At this point, the pivoting member 13 is at the position P1, the top end of the rolling member 15 is kept in rolling contact with the inner side 210 of the handrail belt 21, and the second end 132 of the pivoting member 13 is located outside the recess 310 of the photoelectric sensor 31.

Once an abnormality or failure or the like occurs and the handrail belt 21 is therefore in a disengaged state, the handrail belt 21 will change position. This has been schematically shown in FIG. 6 using another horizontal line L2. This horizontal line L2, as compared to the horizontal line L1, is farther away from a snap-fit structure 220 of the body 22 (i.e., indicating the disengaged state), then the first end 131 of the pivoting member 13 will be completely or partially out of contact with the inner side 210, and the gravity force of the counterweight 14 will cause the pivoting member 13 to continue to pivot around the shaft 12 counterclockwise to reach the position P2. According to the design of the disclosure, the second end 132 of the pivoting member 13 will enter the recess 310 of the photoelectric sensor 31. Since the above-mentioned position change of the second end 132 will affect the photoelectric sensor 31 and a light change is collected by the photoelectric sensor 31, the photoelectric sensor 31 will respond to this and generate a corresponding electrical signal based on the photoelectric effect. This electrical signal constitutes the response signal discussed above, which can reflect the current disengaged state of the handrail belt, so that various possible safety control operations can be implemented accordingly, with the purpose of guaranteeing the safety of passengers and the transmission system in a timely and effective manner.

With reference to the above working process, it can be understood that when the handrail belt 21 is restored to the normal engaged state with the body 22, the inner side 210 of the handrail belt 21 will apply pressure to the rolling member 15 at the first end 131 of the pivoting member 13 so as to force the pivoting member 13 to return from the above-mentioned position P2 to position P1, and the second end 132 will also leave the recess 310 of the photoelectric sensor 31 to be located outside the recess 310. The photoelectric sensor 31 can also respond to this position change of the second end 132, and accordingly generate a corresponding signal that reflects the current engaged state of the handrail belt, so that various possible safety control operations can be implemented based on such a response signal to improve the safety performance of the transmission system.

In the handrail safety control device 100 provided exemplarily, a cover member 10 may also be provided as a part of the contact portion. The cover member 10 can be made of suitable materials such as aluminum alloy, plastic and the like as needed, and can be detachably installed on the top of the base 11 so as to prevent dust, debris and the like from possibly entering the interior of the base 11 to cause adverse effects on internal components. Of course, in some embodiments, it may not be necessary to provide the above-mentioned cover member 10, or it may be optionally made integrally with the base 11 and then components may be assembled from the side or bottom of the base 11.

According to different application requirements, the handrail safety control device may be selectively arranged at any suitable position on the handrail of the transportation system, and the specific number, shape, size and the like of the handrail safety control device at each position can also be flexibly set and adjusted.

Figure 7:
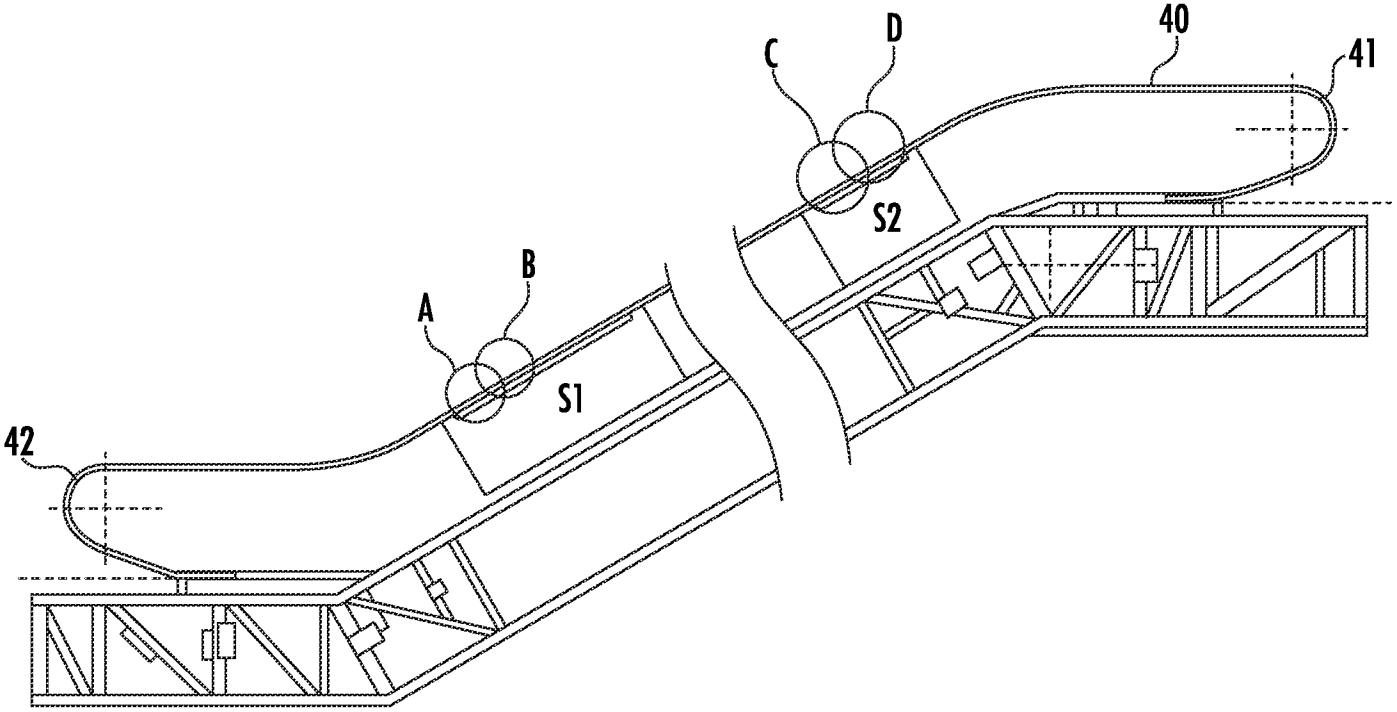
FIG. 7 is a schematic structural side view of an escalator installed with an example of a handrail safety control device according to the disclosure.

Illustratively, referring to FIG. 7, for example, two handrail safety control devices according to the disclosure may be spaced apart and disposed respectively at a lower-end section S1 and/or an upper-end section S2 of the handrail on one or both sides of an escalator 40. That is, one handrail safety control device can be provided at each of positions A and B of the lower-end section S1 and one handrail safety control device can be provided at each of positions C and D of the upper-end section S1. In this way, a total of eight handrail safety control devices can be arranged on the above sections of the handrails on both sides of the escalator 40, thereby forming a system with wide safety protection coverage.

It should be pointed out that the above sections S1 and S2 are often referred to as the R section in the industry. People are easily concerned about the handrail disengagement problem at the return sections 41 and 42 on the escalator 40, but may ignore the handrail safety problem in the above R sections. The related art does not provide handrail safety protection devices used in these sections. The use of the device of the disclosure makes up for the above shortcomings, and can further improve the overall safety performance of escalators and other products.

In addition, it should also be pointed out that for a transportation system having two or more slopes, the disclosure allows one or more handrail safety control devices to be disposed on the handrails on one or both sides of all these slopes, or on the handrails on one or both sides of only some of the slopes to meet the specific needs in different applications.

After the response signal generated by the signal generation portion such as the photoelectric sensor 31 is obtained, it can be used to implement the safety control operation, which can be implemented in many feasible ways.

As an example, the signal generation portion in the handrail safety control device may be connected to a controller for controlling the operation of the transportation system (such as a controller for an escalator, etc.) so as to implement various possible specific safety control operations by the controller. For example, such safety control operations may include, but are not limited to, one or more of the operations illustratively described below: making the transportation system stop providing the power according to the above first response signal, so as to avoid the adverse effects that may cause the handrail belt disengagement area to further expand, endanger the personal safety of the passengers, and cause damage to the devices; making the transportation system re-provide the power according to the above second response signal, so that the system can resume normal work in time and provide transportation services as soon as possible to meet people's needs, thereby improving the service capability and management level of the transportation system; sending alarm information to the outside according to the above first response signal, or stop sending alarm information to the outside according to the above second response signal; wherein the above alarm information may be in any available form such as voice, text, video, image, light, etc., so as to promote people to discover, thus playing the role of notifying, warning, etc.; marking the handrail in the disengaged state on a management end of the transportation system according to the above first response signal, so that system management personnel, maintenance personnel and the like can perform corresponding processing; or cancelling the corresponding mark previously marking the handrail in the disengaged state on the management end of the transportation system according to the above second response signal, so that the display content of the management end is consistent with the actual operating condition of the handrail; notifying the staff or a user terminal of event information related to the handrail; wherein such a user terminal may include but is not limited to a mobile terminal (such as a mobile phone), a dedicated communication device (such as a wireless walkie-talkie, a pager, a building screen), etc., so that the staff can be promoted to timely and quickly know the situation of the current abnormal or faulty handrail, and then rush to the scene as soon as possible or take other measures to deal with the corresponding problems; and transmitting the event information related to the handrail to a local and/or cloud server connected to the transportation system for storage, which will also facilitate an in-depth analysis of abnormalities or failures of the handrail, and promote improvement and raise of product quality or service management level, etc.

As another example, in the case where two or more handrail safety control devices are arranged in a certain handrail area at the same time, the controller for controlling operation of the transportation system may be set to perform the following control operations: if the handrail is currently in a standby mode (that is, the handrail can now be powered at any time according to the application situation to drive the handrail to operate), then the transportation system is controlled to stop providing the power to the handrail after the first response signal generated by one or more handrail safety control devices is received so as to fully ensure the safety and reliability of the system; and/or if the handrail is currently in the operating mode (that is, power is now being provided to the handrail to drive it to operate), after the first response signals generated by N (such as one or two, etc.) handrail safety control devices are received, the transportation system is still controlled to provide the power to the handrail to continue its operation, and after the first response signals generated by M (M>N) handrail safety control devices are received, the transportation system is controlled to stop providing the power to the handrail. The application of the above control strategies can provide an appropriate flexibility of safety control. This is because considering that the possible misreporting of response signals and handrail disengagement failure in local areas may not bring serious risks to the entire system, if the operation of the entire handrail of the transportation system is stopped immediately, unnecessary chaos and influence may be caused. Therefore, it is positive and beneficial to adopt the above control strategy in some occasions.

Of course, it should also be noted that, as an optional situation, after the first response signals generated by the N handrail safety control devices described above are received, although it is not necessary to stop providing the power to the handrail at this time, it is still possible to perform some safety control operations, such as sending alarm information to the outside according to the above first response signal, notifying the user terminal of the staff and/or marking on the management end of the transportation system, etc., which have been exemplified in the foregoing. Reference may be made to these previous contents.

By referring to the examples shown in FIGS. 3 to 7, the general structural composition, working principle and technical advantages of the handrail safety control device according to the disclosure have been described in detail above; however, it should be noted that in the case of not departing from the spirit of the disclosure, the disclosure allows for various possible flexible designs, changes, and adjustments according to actual applications.

For example, although as mentioned above, the handrail safety control device may be composed of a contact portion and a signal generation portion, and the safety control operations are implemented by means of the controller in the transportation system, the disclosure also allows a signal processing portion to be separately configured in the handrail safety control device in some embodiments, wherein the signal processing portion is connected to the signal generation portion and configured to receive the response signals and perform the safety control operations related to the handrail according to the response signals. For example, the above-mentioned signal processing portion can be installed on a warning light, a reminder screen, a buzzer and the like on the scene. The signal processing portion can be used to send warning information in time, can help the field staff to quickly find and solve the problem immediately, and can also remind passengers to take safety precaution measures immediately so that it may not be necessary to stop the operation of the entire handrail at all.

As another example, in the previous example, a situation was discussed in detail in which both the contact portion and the signal generation portion may be integrated into a stand-alone device and then installed in the cavity between the handrail belt and the body. Such a stand-alone device has a compact structure, is easy to manufacture, install and maintain, has a low cost, a wide range of applications and many other advantages. However, it should be noted that the contact portion, the signal generation portion and the above-mentioned signal processing portion are all allowed to be connected and arranged according to application needs. For example, remote wired or wireless method may be used between the contact portion and the signal generation portion, as well as between the signal generation portion and the signal processing portion for signal transmission, so as to achieve a more flexible distributed arrangement.

For another example, in some optional embodiments, the signal generation portion may be implemented using more complex or simple components, units or modules than the photoelectric sensor. For example, the disclosure allows for the direct use of a touch switch, wherein when the contact portion is switched between the first state and the second state, the current state of the touch switch is changed, thereby achieving the effect of generating the corresponding response signal.

In addition, it should be understood that the contact manner between the contact portion and the handrail in the device of the disclosure is not limited to the rolling contact exemplified in the foregoing, and in some embodiments, for example, sliding contact may also be used, and the contact position of the contact portion and the handrail belt may also be set flexibly according to the design needs. Therefore, all the above contents can be included in many possible embodiments of the device of the disclosure.

In view of the fact that the handrail safety control device according to the disclosure has these above described technical advantages that are significantly superior to the related art, it is very suitable to apply it to various existing transportation systems in order to overcome the disadvantages and deficiencies existing in the related art including those described above.

According to the design concept of the disclosure, a transport system is also provided in another technical solution, and one or more handrail safety control devices designed and provided according to the disclosure can be configured in the transport system. That is, by providing such a device, the response signals as described above are provided, and then the above response signals are used to perform safety control operations, so as to realize the function of safety protection of passengers, carried items, devices, etc., thereby significantly improving the safety performance of the existing transportation systems. It should be noted that the transportation systems mentioned in various places of this document may include, but are not limited to, for example, escalators, moving walkways, etc., which can be used to carry various possible transportation objects such as passengers, pets, and goods.

Figure 8:
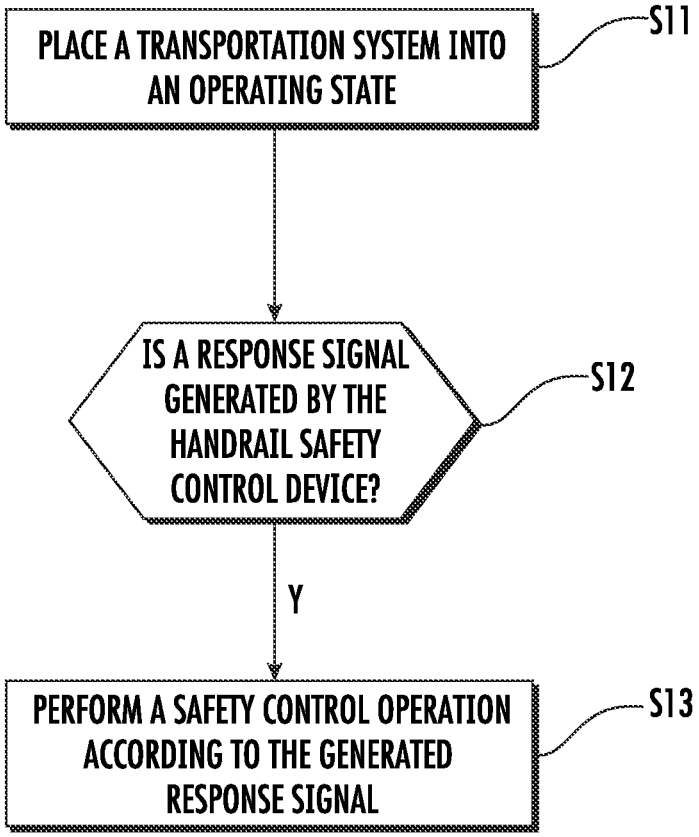
FIG. 8 is a schematic flowchart of an example of a handrail safety control method.

In addition, as another aspect that is significantly superior to the related art, the disclosure also provides a handrail safety control method. As an example, as shown in FIG. 8, in an example of the handrail safety control method, the following steps may be included. first, in step S11, the transportation system may be placed into an operating state; at this time, the handrail may be in an operating state or a standby state, etc., and one or more handrail safety control devices designed and provided according to the disclosure may be provided in the transportation system; in step S12, it can be monitored whether a response signal has currently been generated by the above handrail safety control device; in specific applications, such a monitoring operation may be performed, for example, at the management end of the transportation system or in the signal processing portion in the handrail safety control device; and if, after the monitoring, it is found that a corresponding response signal has been generated, then in step S13, a safety control operation can be performed according to the above response signal, which can be controlled and implemented, for example, through the management end of the transportation system (such as the aforementioned controller, etc.) or the signal processing portion in the handrail safety control device, thus making it possible to advantageously guarantee the safety of passengers, devices of the transportation system, and the like.

It can be understood that since the technical contents such as the generation and application of the response signals, the safety control operations, the controller, the signal processing portion, the configuration of the handrail safety control device, the switching between different states, etc., have been described in great detail above, reference may be made to the specific descriptions of the aforementioned corresponding parts directly, which are not repeated herein.

The handrail safety control device, the transportation system and the handrail safety control method according to the disclosure have been described above in detail by way of example only. These examples are provided merely to illustrate the principle and embodiments of the disclosure, and are not intended to limit the disclosure. Those skilled in the art may also make various variations and improvements without departing from the spirit and scope of the disclosure. Therefore, all the equivalent technical solutions will fall within the scope of the disclosure and are defined by the individual claims of the disclosure.

What is claimed is:

1. A handrail safety control device for a transportation system having a handrail, the handrail comprising a body and a handrail belt, the handrail belt being driven under power to move relative to the body and forming an engaged state or a disengaged state with the body, the handrail safety control device comprising:

a contact portion disposed in a cavity between the body and the handrail belt, the contact portion being in a first state or a second state respectively when the handrail belt in the preset section is in the engaged state or the disengaged state, wherein in the first state, the contact portion is in contact with the handrail belt, and in the second state, the contact portion is at least partially out of contact with the handrail belt; and a signal generation portion configured to generate a response signal in response to a movement of the contact portion between the first state and the second state.

2. The handrail safety control device according to claim 1, wherein the response signal comprises a first response signal and/or a second response signal, the first response signal is generated by the signal generation portion when the contact portion is switched from the first state to the second state, and the second response signal is generated by the signal generation portion when the contact portion is switched from the second state to the first state.

3. The handrail safety control device according to claim 2, wherein the signal generation portion is connected to a controller for controlling the operation of the transportation system, and the controller is configured to perform safety control operations according to the response signals, the safety control operations comprising at least one of the following:

making the transportation system stop providing or re-provide the power respectively, according to the first response signal or the second response signal;

sending or stop sending alarm information respectively, according to the first response signal or the second response signal;

marking the handrail in the disengaged state on a management end of the transportation system or cancelling the mark respectively, according to the first response signal or the second response signal, notifying a staff or a user terminal of event information related to the handrail, the user terminal comprising a mobile terminal; and transmitting the event information related to the handrail to a local and/or cloud server connected to the transportation system for storage.

4. The handrail safety control device according to claim 3, wherein at least two said handrail safety control devices are provided in the preset section, and the controller is configured to:

when the handrail is in a standby mode, make the transportation system stop providing the power after the first response signal generated by at least one handrail safety control device is received; and when the handrail is in an operating mode, make the transportation system not stop providing the power after the first response signal generated by a first preset number of handrail safety control devices are received, and make the transportation system stop providing the power after the first response signals generated by a second preset number of handrail safety control devices are received, the second preset number being greater than the first preset number.

5. The handrail safety control device according to claim 3, wherein the controller is further configured to make the transportation system not stop providing the power and perform at least one other safety control operation of the safety control operations, after the first response signals generated by a preset number of handrail safety control devices are received.

6. The handrail safety control device according to claim 1, wherein the preset section is an upper-end R section and/or a lower-end R section of the handrail on at least one side of the transportation system, and at least two said handrail safety control devices are provided in each preset section.

7. The handrail safety control device according to claim 1, wherein the handrail safety control device further comprises a signal processing portion connected to the signal generation portion and configured to perform the safety control operations related to the handrail according to the response signals.

8. A transportation system, comprising:

a handrail comprising a body and a handrail belt, the handrail belt being driven under power to move relative to the body and forming an engaged state or a disengaged state with the body; and one or more handrail safety control devices according to claim 1, for generating the response signals to perform safety control operations.

9. The transportation system according to claim 8, wherein the transportation system comprises an escalator and a moving walkway.

10. A handrail safety control method, comprising:

placing a transportation system into an operating state, the transportation system being provided with a handrail and one or more handrail safety control devices according to claim 1;

monitoring whether a response signal has currently been generated by the handrail safety control device; and if the response signal has been generated, performing a safety control operation according to the response signal.

11. A handrail safety control device for a transportation system having a handrail, the handrail comprising a body and a handrail belt, the handrail belt being driven under power to move relative to the body and forming an engaged state or a disengaged state with the body, the handrail safety control device comprising:

a contact portion disposed in a preset section of the handrail, the contact portion being in a first state or a second state respectively when the handrail belt in the preset section is in the engaged state or the disengaged state, wherein in the first state, the contact portion is in contact with the handrail belt, and in the second state, the contact portion is at least partially out of contact with the handrail belt; and a signal generation portion configured to generate a response signal in response to a switching of the contact portion between the first state and the second state;

wherein the response signal comprises a first response signal and/or a second response signal, the first response signal is generated by the signal generation portion when the contact portion is switched from the first state to the second state, and the second response signal is generated by the signal generation portion when the contact portion is switched from the second state to the first state;

wherein the contact portion comprises:

a base configured to be installed in a cavity between the handrail belt and the body;

a shaft installed on the base;

a pivoting member pivotally installed on the base around the shaft, and having a first end facing an inner side of the handrail belt and a second end facing the signal generation portion; and a counterweight installed between the second end and the shaft, and configured to cause the first end to be in contact with or at least partially out of contact with the inner side respectively when in the first state or the second state, and to cause the signal generation portion to generate the first response signal and/or the second response signal through a corresponding position change of the second end relative to the signal generation portion.

12. The handrail safety control device according to claim 11, wherein the signal generation portion comprises a photoelectric sensor installed on the base and having a recess, when the contact portion is switched from the first state to the second state, the second end enters the recess from the outside to cause the photoelectric sensor to generate the first response signal, and when the contact portion is switched from the second state to the first state, the second end leaves the recess to cause the photoelectric sensor to generate the second response signal.

13. The handrail safety control device according to claim 11, wherein the first end is provided with one or more rolling members for rolling-contact with the inner side.

14. The handrail safety control device according to claim 11, wherein a fastener is provided between the shaft and the pivoting member, and the fastener comprises a snap spring.

15. The handrail safety control device according to claim 11, wherein the contact portion further comprises a cover member detachably installed on the top of the base.

16. A handrail safety control device for a transportation system having a handrail, the handrail comprising a body and a handrail belt, the handrail belt being driven under power to move relative to the body and forming an engaged state or a disengaged state with the body, the handrail safety control device comprising:

a contact portion disposed in a preset section of the handrail, the contact portion being in a first state or a second state respectively when the handrail belt in the preset section is in the engaged state or the disengaged state, wherein in the first state, the contact portion is in contact with the handrail belt, and in the second state, the contact portion is at least partially out of contact with the handrail belt; and a signal generation portion configured to generate a response signal in response to a switching of the contact portion between the first state and the second state;

wherein the response signal comprises a first response signal and/or a second response signal, the first response signal is generated by the signal generation portion when the contact portion is switched from the first state to the second state, and the second response signal is generated by the signal generation portion when the contact portion is switched from the second state to the first state;

wherein the contact portion comprises:

a base configured to be installed in a cavity between the handrail belt and the body;

a shaft installed on the base;

a pivoting member pivotally installed on the base around the shaft, and having a first end facing an inner side of the handrail belt and a second end facing the signal generation portion; and the pivoting member configured to cause the signal generation portion to generate the first response signal and/or the second response signal through a corresponding position change of the second end relative to the signal generation portion.

* * * * *